US006964393B1

(12) United States Patent
Kojo et al.

(10) Patent No.: US 6,964,393 B1
(45) Date of Patent: Nov. 15, 2005

(54) METHOD IN SEQUENTIAL WINDING STATIONS AND PRODUCTION LINE COMPRISING SEQUENTIAL WINDING STATIONS

(75) Inventors: Teppo Kojo, Mantsala (FI); Esa Aalto, Hyvinkää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/763,745

(22) PCT Filed: Aug. 26, 1999

(86) PCT No.: PCT/FI99/00701

§ 371 (c)(1),
(2), (4) Date: Feb. 26, 2001

(87) PCT Pub. No.: WO00/12418

PCT Pub. Date: Mar. 9, 2000

(30) Foreign Application Priority Data

Aug. 26, 1998 (FI) ..... 981825

(51) Int. Cl.[7] ..... B65H 18/08

(52) U.S. Cl. ..... 242/531; 242/530.4; 242/533

(58) Field of Search ..... 242/531, 533, 242/533.1, 530.4, 531.1, 542, 525

(56) References Cited

U.S. PATENT DOCUMENTS

| | | | | |
|---|---|---|---|---|
| 2,092,966 | A * | 9/1937 | Gay et al. | |
| 3,097,807 | A * | 7/1963 | Erskine | |
| 3,690,583 | A * | 9/1972 | Herman | |
| 3,779,475 | A * | 12/1973 | Plevin | |
| 4,055,313 | A * | 10/1977 | Yamaguchi et al. | 242/530.4 |
| 4,117,986 | A * | 10/1978 | Hutzenlaub | 242/530.4 |
| 4,293,101 | A * | 10/1981 | Dunaevsky et al. | |
| 4,346,852 | A * | 8/1982 | Kawada et al. | |
| 4,600,465 | A * | 7/1986 | Delannoy | |
| 5,967,447 | A * | 10/1999 | Hinz et al. | |
| 6,073,824 | A * | 6/2000 | Gray et al. | |
| 6,371,399 | B1 * | 4/2002 | Marchante | |

* cited by examiner

*Primary Examiner*—William A. Rivera
(74) *Attorney, Agent, or Firm*—Steinberg & Raskin, P.C.

(57) ABSTRACT

The invention relates to a method in sequential winding stations which are in a production line processing the web at successive stages. In the method the paper web issuing from a paper machine (PK) is reeled in a reel-up (KR1) around a reel spool (T1) to form a reel, the paper web is unwound in an unwind (AR) from the reel to the finishing machine (JK) for paper, and the paper web passed through the finishing machine (JK) for paper is reeled in a reel-up (KR2) around a reel spool (T2) to form a reel. At least the reel spools (T1) used in the area between the reel-up (KR1) of the paper machine (PK) and an unwind thereafter, have different dimensions, advantageously larger diameters, than the reel spools (T2) used later in the production line.

10 Claims, 2 Drawing Sheets

METHOD IN SEQUENTIAL WINDING STATIONS AND PRODUCTION LINE COMPRISING SEQUENTIAL WINDING STATIONS

FIELD OF THE INVENTION

The invention relates to a method in sequential winding stations, which method is presented in the preambles of the appended claims 1 and 7. The invention also relates to a production line comprising sequential winding stations.

BACKGROUND OF THE INVENTION

The production of paper from pulp to finished paper may be composed of several sequential winding and unwinding stages in which the continuous paper web passed from the preceding processing stage is reeled around a reel spool to form a machine reel, and this machine reel is unwound again at the unwinding stage to pass the paper web to the next processing stage. A typical example is a so-called off-line production of coated paper grades, in which in the paper production line i.e. in the paper machine a continuous web of several meters in length is produced from fibrous pulp, which web is reeled in the reel-up in the terminal end of the paper machine to form a machine reel. Several reel-ups have been presented in the patent literature, and reference can be made for example to the European patents 483092, 483093 and to the international patent publication WO 95/34495. In such winding stations a continuous web passed from the preceding sections of the machine is reeled around a reeling axle i.e. a reel spool, which is a roll of several meters in width, dimensioned with respect to the size of the reel in a suitable way and supported in the winding station by its ends with a suitable supporting structure. The winding stations operate continuously, wherein a new reel spool is brought to the reeling station without reducing the speed of the preceding machine, and the paper web is guided around a new reel spool by using change methods for which numerous patented solutions have been developed. Similarly, patented solutions have been developed for the ways of arranging a loading (linear load) between the reeling cylinder guiding the web and the reel.

In the unwind, the machine reel reeled in the preceding stage is unwound, and a winding station of this type is presented for example in the Finnish patent 100323 and in the corresponding U.S. Pat. No. 5,709,355. The unwind of a coater presented herein operates continuously, wherein a new machine reel which is brought to the unwind is joined at full speed to the paper web of a machine reel that is becoming empty, by means of a splicing device. The unwind is used in the beginning of off-machine coaters to lead the web wound up in the preceding winding station from the successive reels to the coating process. The preceding winding station can be a so-called rereeler in which the reel reeled in the reel-up of a paper machine is unwound and wound up to form a reel which is suitable for the finishing process.

In the end of the off-machine coater there is again a reel-up in which the paper web passed from the coater is reeled around the reel spool again to form a machine reel.

In order to implement the continuous operation, the change of the reels in the reel-up and in the unwind should proceed without problems, and these functions are the most critical stages in the continuous winding up or unwinding. Because of this, it would be advantageous to produce machine reels as large as possible to reduce the number of changes. This is restricted by the heavy weight (several tens of tonnes, in wide machines typically over 50 tonnes) of the reel, and the existing constructions which are dimensioned for particular maximum diameters of the machine reel.

Heretofore, attention has been paid to single winding processes (winding up, unwinding) and their problems.

Conventionally, in lines producing coated paper grades, for example in an LWC-paper line provided with a separate coater, machine reels of equal size are reeled in the reel-up of the paper machine and thereafter in each reel-up process in accordance with the requirements set for the customer rolls of the slitter-winder.

Especially in lines producing coated paper grades, as for example the above-mentioned LWC line, it is difficult to modernize the winding stations in such a way that the diameter of the reel is increase throughout the entire line, because in that case all the reel-up unwinds, cranes, reel spools (nearly 100 by number) and storage rail arrangements have to be modernized. Similarly, inside a factory the lifting height might restrict the growth of the diameter at some points. Thus, when compared to the attained advantages, it is not lucrative to increase the diameters of the reels, even if new winding station constructions provided the possibility for this.

OBJECTS AND SUMMARY OF THE INVENTION

The purpose of the invention is to eliminate the aforementioned drawbacks and to present a new reeling concept in a production line comprising sequential winding stations. To attain this purpose, the method is primarily characterized in what will be presented in the characterizing part of the appended claim 1.

The invention utilizes the short circulations of the reel spools between the reeling-up and unwinding stages. Thus, the reel spools in the production line are dimensioned to be different in size, and it is possible to use a different size in each circulation. Similarly, it is possible to dimension the winding stations for reel spools of different sizes, and for maximum diameters of the reel. Heretofore, it has been natural to use reel spools of equal size in the entire production line, wherein they can be utilized anywhere.

The invention is also characterized by the facts stated in the characterizing part of the appended claim 7. By reeling larger quantities of paper in the first reel-up than in the second reel-up, which is located at some point after the first reel-up in the production line, it is possible to reduce the number of changes in the beginning of the line.

The invention enables a suitable modernizing solution for the winding stations in the production line, by means of which a greater advantage is achieved with smaller investments. Thus, it is only necessary to modernize the winding stations in the beginning of the line, such as the reel-up of the paper machine and the rereeler and the unwind of the coater for paper for the part of the maximum diameter, and possibly the winding stations therebetween. In addition, new, bigger reel spools (20 to 30 by number) are required in this interval as well as a possible additional capacity of one crane. Between the paper machine and the coater for paper the circulation of the reel spools functions completely independently, i.e. the new rolls remain only within this interval.

Similarly in lines where coated grades are produced with on-line coating in a paper machine, it is possible to modernize the reel-up of the paper machine and arrange new reel spools at least in the area between the reel-up and the rereeler.

BRIEF DESCRIPTION OF DRAWINGS

In the following, the invention will be described in more detail with reference to the appended drawings, in which.

DETAILED DESCRIPTION OF THE PREFERRED EMBODIMENTS

Figure 1:
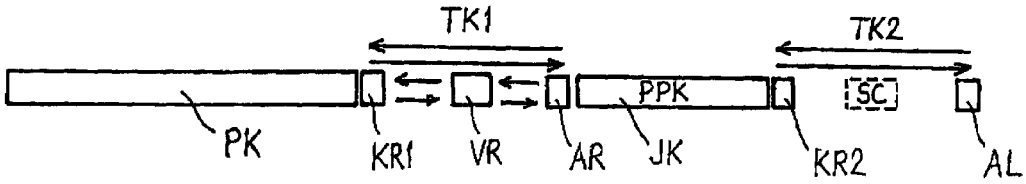
FIG. 1 shows a method and a production line according to the invention.

FIG. 1 illustrates a paper production line according to the invention in a schematical top view. The line comprises the following sequential parts of the production and finishing process for paper:

- a paper machine PK, which produces from fibrous pulp a continuous paper web which fulfills particular quality requirements,
- a reel-up KR1 of a paper web which is arranged to reel the continuous web passed from the paper machine around the reel spools to form successive machine reels,
- a rereeler VR which is equipped with an unwind and a reel-up, and which is arranged to unwind the machine reels formed by the reel-up KR1 and to form machine reels suitable for the finishing process from the unwound web, wherein it is possible to remove paper of bad quality at the same time and to join the so-called web break reels coming from the paper machine together to full-sized machine reels,
- an unwind AR of the finishing machine for paper, which is arranged to unwind the machine reels and to splice the webs of successive machine reels together,
- a finishing machine JK for paper, which receives a continous web from the unwind AR and conducts a finishing treatment, such as coating, for the paper, which is important in view of the quality of the end product,
- a reel-up KR2 for the finishing machine JK for paper, which is arranged to reel the continuous web passes from the finishing apparatus around the reel spools to form successive machine reels in a similar way as the reel-up KR1 of the paper machine,
- an unwinding device AL, such as a slitter-winder, which unwinds the machine reels formed with the preceding reel-up KR2 and forms customer rolls thereof which have suitable dimensions for the end use of the product.

In the paper machine, the rereeler and the finishing machine a full-width web is processed, the width of the web corresponding substantially to the production width of the paper machine. This web is divided into narrower webs in the slitter-winder after the unwinding to form customer rolls of particular width.

In FIG. 1, the finishing machine JK is a coater for paper, a so-called off-machine coater, which is marked with the letter combination PPK.

In the paper machine, machine reels are reeled from the paper web passed from the production process, the weight of the reels being typically over 10 tons, depending on the amount of full-width paper web to be reeled.

A separate circulation of the reel spools is arranged between the reel-up KR1 of the paper machine and the unwind AR of the finishing machine for paper, and it is illustrated with arrows TK1. From the unwind AR of the paper finishing machine JK, the reel spools are returned to the reel-up KR1 of the paper machine PK, wherefrom they travel inside the machine reels back to the unwinder AR. Because this first part of the paper production line has a separate circulation of the reel spools, the reel spools can be different, and they advantageously have a larger diameter than the reel spools employed in the terminal end. In the terminal end, i.e. between the reel-up KR2 of the finishig machine JK for paper and the unwinding device AL following thereafter, there is a separate circulation TK2 of the reel spools.

Similarly, the winding stations KR1, VR and AR preceding the finishing machine JK for paper can be dimensioned for larger machine reels, which contain advantageously at least a double amount of paper when compared to the machine reels formed in the reel-up KR2 after the finishing machine JK for paper. This reduces the number of changes conducted in the terminal end of the paper machine PK and in the beginning of the finishing machine JK for paper. Thus it is also possible to attain more running time between the changes, and thereby more capacity in the rereeler VR.

In lines whose principle complies with FIG. 1, it is only necessary to modernize the winding stations KR1, VR and AR and possible other constructions in the beginning. After the modernization, a double length or another suitable larger than previously length of paper is run between the paper machine PK and the finishing machine JK for paper, such as a coater for paper, to form a machine reel, wherein the splicing operations of the finishing machine JK and thereby also the risk for break (splicing+leading through the splices) is halved and reduced in a corresponding proportion. For example in a coater for paper with four stations, one break typically lasts about an hour and includes cleaning, washing and tail threading. The efficiency of the coater for paper can be considerably improved with this arrangement also in other respects, because the greatest production is attained and the production control is easiest with an even operational run. It is possible to produce big machine reels in the reel-up KR1 in the terminal end of the paper machine PK with the help of the new reeling technique and the new reel spools. At the same time, the total output of the line is increased by means of the improved reeling efficiency (bottom and surface broke is reduced in the reel up and the rereeler of the paper machine, change breaks are reduced). Modernization is restricted to a smaller area in the factory, and the remaining sections after the finishing machine JK for paper, such as a coater for paper function in a similar way as before. Thus, the same number of changes as before is conducted in the reel-up KR2 of the finishing machine JK, because the sizes of the machine reels in the terminal end of the entire line remain unchanged after the modernization.

Figure 2:
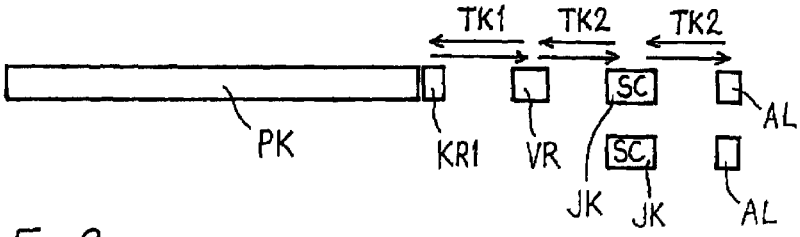
FIG. 2 shows a second possible production line.

In FIG. 1, the finishing machine for paper is a coater for paper. FIG. 2 shows another possible line in which on-machine coated paper is produced with a paper machine PK. Thus, the circulation TK1 of reel spools of different dimensions is effective between the reel-up KR1 and the rereeler VR. After the rereeler, the finishing machine JK is an off-line calender, such as a supercalender (marked with the letter combination SC), which is provided with an unwind for unwinding the web from the machine reel and guiding it through the calender and a reel-Up for gathering the calendered web on the reel. After the off-line calender there is an unwinding device AL, such as a slitter-winder, in which the machine reel reeled up in the off-line calender is unwound and customer rolls of suitable length are formed thereof. The unwinding of the off-line calender is not continuous, and, as can be seen in FIG. 2, there may be two or more calenders and slitter-winders next to each other. The reel-up KR1 utilizes reel spools with a larger diameter, and it is used for forming larger machine reels than those formed in the rereeler VR, whereafter the circulations TK2 of smaller diameter reel spools are effective between the rereeler and the off-line calender and between the off-line calender and the unwinding device AL. With the rereeler VR smaller reels a reeled, for example two small machine reels from one large machine reel. In the modernization, it is sufficient that the reel-up KR1 of the paper machine PK is modernized for the part of the maximum diameter, and new, larger reel spools are disposed between the reel-up KR and the rereeler VR.

Figure 3:
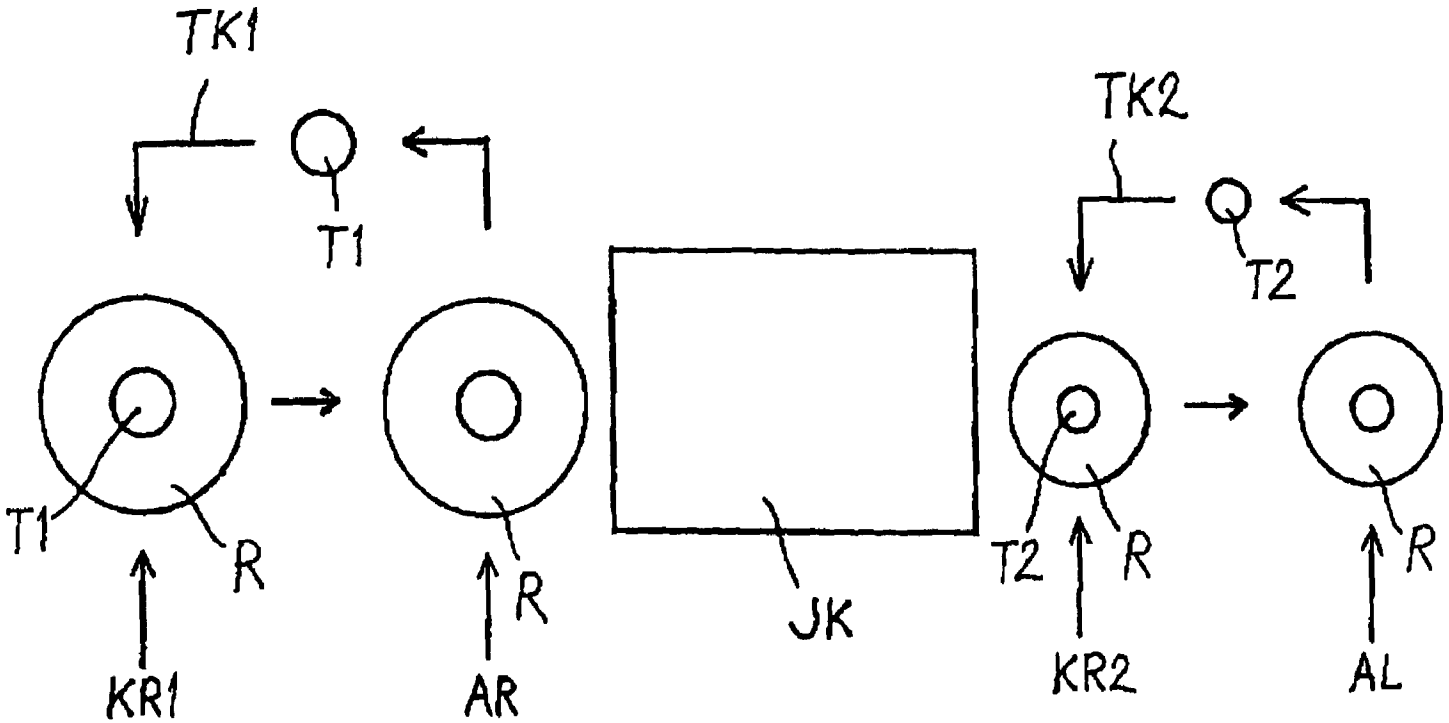
FIG. 3 illustrates the circulation of the reel spools in a side view.

Furthermore, FIG. 3 illustrates in a simplified manner the two different circulations TK1 and TK2 of the reel spools, the diameters of different sizes of the reel spools T1 and T2 transferred therein, as well as the machine reels R of different sizes travelling in the circulation. Between the rotations there may be any finishing machine JK for paper. The advantages of the invention become clearly apparent if the finishing machine for paper is such a machine to which paper web is continuously passed from its unwind AR, with "flying" changes from the successive machine reels by splicing the webs of different reels together, in a similar way as when passing the paper web to the coater PPK for paper. However, the invention can also be used in situations where the paper web is passed from the machine reels R to the finishing machine JK in such a way that the webs of different reels are passed separately from each other, wherein there is a pause between the successive runs of the web. Especially in the latter case in which the webs of the machine reels R are not spliced to each other, the circulation TK1 of the larger reel spools T1 can be effected only between the reel-up KR1 of the paper machine and the rereeler VR preceding the finishing machine JK, in a manner described in FIG. 2, and larger machine reels R are reeled up and unwound within this interval.

The new reel spools can have a diameter which is at least 25%, advantageously at least 35% larger than the diameter of the old reel spools. As an example of a suitable dimensioning of the new and old reel spools and machine reels, it is possible to present the following values, which do not restrict the invention:

| | |
|---|---|
| Old (T2) | |
| diameter of the reel spool | 700 mm |
| diameter of the machine reel | 2400 mm |
| length of the paper on the reel | about 70 km |
| New (T1) | |
| diameter of the reel spool | 1300 mm |
| diameter of the machine reel | 3500 mm |
| length of the paper on the reel | about 140 km |

The invention is not restricted solely to the alternatives presented above, but it can be modified within the scope of the inventive idea presented in the claims. In FIG. 1, the circulation TK1 of the reel spools of different dimensions can be arranged between the paper machine reel-up KR1 and the rereeler VR, and a separate circulation may be provided between the rereeler VR and the unwind AR, the reel spools of which have the same dimensions as those in circulation TK1. Thus, the same advantage is attained in the unwinding. The circulations can be arranged freely according to the situation, because the same reel spools can be used anywhere in the area between the reel-up KR1 and the unwind AR. Furthermore, in FIG. 1 broken lines illustrate an off-line calender, such as a supercalender SC, located after the reel-up KR2 of a coater PPK for paper, wherein a separate circulation TK2 of the reel spools may be provided after the reel-up KR2 and the off-line calender. Also in this line, there may be several calenders and unwinding devices AL following thereafter, located in parallel relationship in the way shown in FIG. 2. In the line, there may also be other treatment devices known in the field, and it is possible to use suitable placement solutions of the devices therein, while the basic principle of the invention remains the same.

It is also apparent that, irrespective of the size of the reel spools, larger reels are reeled in the winding station located at an earlier position in the line (the first reel-up) than with a winding station located later in the line (the second reel-up). Thus, the advantage is attained that in the beginning, before the second reel-up, there are fewer reel changes in some reeling up process and at least in the unwinding process following this reeling up process. The reel spools in the line can also be equal in size, provided that they are suitable for the larger reel size. Larger reels, preferably at least with a double amount of paper, can be used for transferring the paper between the reel-up KR1 of the paper machine and the unwind AR of the finishing machine. It is also possible that larger reels, preferably with a double amount of paper, are reeled not earlier than in the reel-up of the rereeler VR and unwound in the following unwind AR of the finishing machine JK, for example in the unwind of the coater for paper PPK or in the unwind of the supercalender SC, the reels to be reeled in the second reel-up in the terminal end thereof being again smaller (the reel-up in the coater PPK for paper or in the supercalender SC). Thus, it is possible to arrange the circulation of larger reel spools only between the reel-up of the rereeler VR and the unwind AR of the finishing Machine JK, if it is necessary to use larger reel spools for larger reels.

The present invention has been described herein with reference to preferred embodiments of the invention however the description provided herein is for illustrative purposes and should not be considered to be exhaustive. It is understood that modifications and variations of the above describe preferred embodiments are possible without departing from the spirit or scope of the present invention.

What is claimed is:

1. Method in sequential winding stations which are located in a production line processing a paper web at successive stages, comprising the steps of:

providing a full-width paper web issuing from a paper machine having a production width;

providing a plurality of first reel spools;

reeling said full-width paper web around one single reel spool of said plurality of first reel spools in a first reel-up at a time to form a reel;

passing said reel to an unwinding station;

unwinding the full-width paper web from the reel in said unwinding station and returning the empty first reel spool to said first reel-up;

passing said full-width paper web to a finishing machine;

passing the full-width paper web through the finishing machine;

providing a plurality of second reel spools;

reeling said full-width paper web around one single reel spool of said second reel spools in a second reel-up at a time to form a reel;

wherein each of said plurality of first reel spools employed at said first reel-up and passed to said unwinding station having a different dimension than each of said plurality of second reel spools.

2. Method according to claim 1, wherein the unwinding station is a continuous unwinding station.

3. Method according to claim 1, wherein the second reel spool further comprising the steps of:

employing said plurality of said second reel spools during subsequent stages of the production line after said second reel-up.

4. Method according to claim 1, wherein in the first reel-up larger amounts of paper web are reeled on the first reel spool than is reeled on the second reel spool in the second reel-up.

5. Method according to claim 1, wherein the finishing machine for paper is a coater for paper or an off-line calender.

6. Method according to claim 1, wherein said first reel spool has a larger diameter than said second reel spool.

7. Method in sequential winding stations which are located in a production line for processing a paper web at successive stages, comprising the steps of:

providing a full-width paper web issuing from a preceding production stage and reeling the full-width paper web in a first reel-up around one single first reel spool at a time to form a first reel, unwinding the full-width paper web from the first reel in an unwinding station, and reeling the full-width paper web in a second reel-up around one single second reel spool at a time to form a second reel, wherein a larger amount of paper is reeled onto said first reel spool in said first reel-up than is wound onto said second reel spool in said second reel-up.

8. Method according to claim 7, further comprising the steps of:

passing said full-with paper web through a finishing machine before winding said full-width paper web on said second reel spool in said second reel-up.

9. Method according to claim 8, wherein said larger amount of paper reeled on to said first reel is at least twice the amount of paper reeled onto said second reel.

10. Method according to claim 7, wherein said larger amount of paper reeled on to said first reel is at least twice the amount of paper reeled onto said second reel.

* * * * *